US006177197B1

(12) United States Patent
Imashiro et al.

(10) Patent No.: US 6,177,197 B1
(45) Date of Patent: Jan. 23, 2001

(54) PRINTING AND RECORDING SHEET

(75) Inventors: Yasuo Imashiro; Ikuo Takahashi; Naofumi Horie; Takeshi Yamane; Shigekazu Suzuki, all of Tokyo (JP)

(73) Assignee: Nippon Industries, Inc., Tokyo (JP)

( * ) Notice: Under 35 U.S.C. 154(b), the term of this patent shall be extended for 0 days.

(21) Appl. No.: 09/079,216

(22) Filed: May 15, 1998

(30) Foreign Application Priority Data

May 16, 1997 (JP) ..... 9-143576

(51) Int. Cl.[7] ..... B41M 5/00
(52) U.S. Cl. ..... 428/423.1; 428/195; 428/522
(58) Field of Search ..... 428/195, 522, 428/423.1

(56) References Cited

U.S. PATENT DOCUMENTS 5,208,378 5/1993 Yoneyama et al. .
5,460,874 10/1995 Rao .

FOREIGN PATENT DOCUMENTS 0648611A 4/1995 (EP) .
0686626A 12/1995 (EP) .
63-183874A 7/1988 (JP) .

*Primary Examiner*—Pamela R. Schwartz
(74) *Attorney, Agent, or Firm*—Birch, Stewart, Kolasch & Birch, LLP.

(57) ABSTRACT

A printing and recording sheet comprises a substrate and an ink receiving layer of a crosslinked product of a composition which comprises a polymer resin and a crosslinking agent comprising a water-soluble or dispersible carbodiimide compound which is a condensation reaction product obtained by decarbonation condensation of at least one diisocyanate or a mixture of at least one diisocyanate and at least one triisocyanate. The reaction product is blocked at terminal isocyanate groups with a hydrophilic group.

17 Claims, No Drawings

PRINTING AND RECORDING SHEET

BACKGROUND OF THE INVENTION

This invention relates to a recording sheet for printing having a coating layer which comprises a polyvinyl alcohol resin (PVA) as a resin component and which has an improved water resistance, a reduced degree of blotting and good ink absorbency, and enables a highly clear print. The recording sheet is especially adapted for ink jet recording.

For recording mediums for various printings and recordings including gravure, letterpress, ink jet printing and recordings, it is usual to use ordinary paper. As high performances in printing and recording techniques, such as a high printing and recording speed and multicolor recording or printing, are now in progress, higher characteristic properties are required of printing and recording paper.

Especially, in the ink jet recording system, ink droplets are produced according to an ink jetting system such as an electrostatic suction system using application of high voltage or a system wherein an ink is mechanically vibrated or displaced by means of a piezoelectric element. The droplets are jetted against a material to be recorded, e.g. paper, and deposited thereon as recorded. Since this system involves a reduced occurrence of noises, is easy in coloration, and ensures high-speed recording and printing, it has been widely applied to various types of printers. In recent years, the ink jet recording machine is developed to realize high speed and multicolor operations. This, in turn, strongly requires a higher quality of ink jet recording paper.

More particularly, the ink jet recording paper should have such characteristics: (1) an absorption speed of ink is high; (2) ink dots have a diameter which is not larger than required (not blotted); (3) when ink dots are superposed, an ink dot or dots deposited later are not run out over the dots deposited beforehand; and (4) an ink jet recording sheet has a good water resistance.

Extensive studies have been now made in order to improve printability or recording properties by coating an absorbing material for water-soluble ink jet recording ink, e.g. paper, or a sheet or film of a plastic material such as polyethylene terephthalate, polyethylene, polypropylene or the like, with a water-soluble resin such as a polyvinyl alcohol (PVA) resin. However, there arises the problem that blotting of an ink on the absorbing material causes a diameter of an ink dot to be larger than required, with a loss of the clarity, and a water resistance lowers considerably.

On the other hand, the ink jet recording system may be used such that transparent films made of various types of plastics including polyethylene terephthalate (PET), polypropylene, polyethylene and nylons are provided as a material to be recorded and are directly printed thereon for use as OHP sheets or for observation of transmitted light through color displays.

In this case, however, the absorption speed of a water-soluble ink is not satisfactory. If a water-soluble resin is coated and a printed film is immersed in water, not only the water-soluble resin is dissolved out, but also intimate contact between the film and the water-soluble resin cannot be obtained, thereby presenting the problem that the resin in whole is separated from the film.

In order to solve the above problem, an attempt has been made to appropriately control the degree of saponification of PVA resin which is a water-soluble resin, thereby improving the water resistance through hydrogen bond after coating of the film. Alternatively, other attempts have been made so as to improve the water resistance, in which PVA resin is imparted with a cationic or anionic functional group as described in Japanese Laid-open Patent Application No. 63-183874, and in which a crosslinking agent is used so that functional groups are crosslinked.

However, the PVA resin, which has a controlled degree of saponification or which has cationic or anionic functional groups, cannot be crosslinked to a satisfactory extent. Thus, adequate water-resistant properties cannot be imparted thereto.

On the other hand, in the methods of using a crosslinking agent, it is usual to use, as such a crosslinking agent, aziridine compounds, epoxy compounds, blocked isocyanate compounds, oxazoline compounds and the like. The method of using oxazoline compounds and/or blocked isocyanate compounds among them has the problem that a curing temperature is as high as 80 to 180° C., so that an expensive equipment is necessary and a substrate to be coated having a low heat resistance cannot be employed. Especially, blocked isocyanate compounds may adversely influence environment and the body of a worker because a blocking agent used to block isocyanate groups is volatilized upon curing.

The crosslinking agents made of aziridine compounds and/or epoxy compounds are disadvantageous in that since these compounds are so low storage stability that when stored under high temperature and high humidity conditions, they are polymerized and hardened, and that they have very strong toxicity, and greatest care must be paid to handling.

Moreover, conventional crosslinking agents are not satisfactory with respect to reactivity at low temperatures, and are not sufficiently miscible with water-soluble resins to be crosslinked. Thus, a desirable water resistance cannot be imparted to water-soluble resins.

SUMMARY OF THE INVENTION

It is therefore an object of the present invention to provide a printing and recording sheet which is adapted particularly for ink jet recording and which has a favorable ink absorption speed and a good water resistance, and ensures clear recording and printing especially in case where PVA resin is employed as a resin component.

In order to achieve the above object, we have made intensive studies. As a result, it has been found that the above object can effectively be attained by the use of a water-soluble or dispersible carbodiimide crosslinking agent comprising a carbodiimide compound, as a main component thereof, which consists essentially of a condensation reaction product obtained by decarbonation reaction of diisocyanates or a mixture of diisocyanates and triisocyanates wherein the condensation reaction product is blocked at terminal isocyanate groups with a hydrophilic group and has at least one —NCN— group. More particularly, it is preferred to use the carbodiimide crosslinking agent comprising, as its main component, a carbodiimide compound obtained by decarbonation reaction in the presence of a catalyst for carbodiimidization between one or more isocyanates selected, as diisocyanates and triisocyanates, from 4,4'-dicyclohexylmethane diisocyanate (HMDI), tetramethylxylylene diisocyanate (TMXDI), isophorone diisocyanate (IPDI), 2,4,6-triisopropylphenyl diisocyanate (TIDI), 4,4'-diphenylmethane diisocyanate (MDI), tolylene diisocyanate (TDI), hydrogenated tolylene diisocyanate (HTDI) and isocyanates having at least two isocyanate groups bonded to the carbon of the methylene group in the molecule, and a monofunctional water-soluble or dispersible organic compound. This crosslinking agent has good water solubility or dispersibility, good reactivity with a polymer resin to be crosslinked, particularly PVA resin, and good miscibility with PVA resin. The agent is capable of effectively crosslinking PVA resin at low temperatures. Accordingly, when a PVA composition formulated with this crosslinking agent is coated onto or internally added to a substrate for printing and recording sheet such as a paper sheet or a plastic film, and is crosslinked to form a crosslinked PVA resin ink receiving layer, the resultant sheet for ink jet recording can satisfy all the characteristic requirements for materials to be recorded thereon in an ink jet recording system, with respect to the water resistance, ink absorbency, adhesion properties and clarity of printed matter. More particularly, the sheet meets the following requirements: (1) an absorption speed of ink is high; (2) ink dots have a diameter which is not larger than required (not prone to blot); (3) when ink dots are superposed, an ink dot or dots deposited later are not run out over the dots deposited beforehand; (4) an ink jet recording sheet has a good water resistance; and an adhesion between the support substrate and the PVA coating is high. Accordingly, the sheet is effectively responsible for now improved performances of ink jet recording machines, such as of high speed and multicolor recording. The present invention is accomplished based on the above finding.

According to the invention, there is provided a printing and recording sheet comprising a substrate and an ink receiving layer, said ink receiving layer being a crosslinked product of a composition which comprises a polymer resin, and a crosslinking agent comprising, as its main component, a water-soluble or dispersible carbodiimide compound which consists essentially of a condensation reaction product obtained by decarbonation condensation of at least one diisocyanate or a mixture of at least one diisocyanate and at least one triisocyanate, the reaction product being blocked at terminal isocyanate groups with a hydrophilic group. Preferably, the polymer resin is a polyvinyl alcohol (PVA) resin.

DETAILED DESCRIPTION OF THE INVENTION

The printing and recording sheet of the present invention comprises a substrate, and an ink receiving layer. The layer is made of a crosslinked product of a coating material or composition comprising a polymer resin and a crosslinking agent. The crosslinking agent comprises, as its main component, a water-soluble or dispersible carbodiimide compounds consisting essentially of a condensation reaction product obtained by decarbonation condensation of a diisocyanate or a mixture of a diisocyanate and a triisocyanate wherein the reaction product is blocked at terminal isocyanate groups with a hydrophilic group.

The diisocyanates and triisocyanates may be any of alicyclic isocyanates, aliphatic isocyanates, and aromatic isocyanates and should have at least two isocyanate groups, preferably two isocyanate groups, in the molecule.

Such isocyanates include, for example, (A) one or more isocyanate compounds selected from 4,4'-dicyclohexylmethane diisocyanate (HMDI), tetramethylxylylene diisocyanate (TMXDI) and isophorone diisocyanate (IPDI), 2,4,6-triisopropylphenyl diisocyanate (TIDI), 4,4'-diphenylmethane diisocyanate (MDI), tolylene diisocyanate (TDI), and hydrogenated tolylene diisocyanate (HTDI), i.e. one or more isocyanate compounds having no isocyanate group bonded to the carbon atom of the methylene group in the molecule, and (B) one or more alicyclic, aliphatic and/or aromatic isocyanates having isocyanate groups bonded to the carbon atom or atoms of the methylene group in the molecule and selected, for example, from hexamethylene diisocyanate (HDI), hydrogenated xylylene diisocyanate ($H_6XDI$), xylylene diisocyanate (XDI), 2,2,4-trimethylhexamethylene diisocyanate (TMHDI), 1,12-diisocyanatododecane(DDI), norbornane diisocyanate (NBDI) and 2,4-bis-(8-isocyanatooctyl)-1,3-dioctylcyclobutane (OCDI).

As an isocyanate used in the present invention, the isocyanates defined in (A) or (B) may be used singly, or the mixture of the isocyanates (A) and (B) may be used. If the mixture of the isocyanates (A) and (B) is used, it is favorable that the mixing ratio (by mole) between the isocyanate groups of the isocyanate (A) and the isocyanate groups of the isocyanate (B) is 50:1 to 1:20, preferably 20:1 to 1:10.

The hydrophilic group, which blocks the terminal isocyanate groups of the condensate obtained by decarbonation condensation of the isocyanates, may be appropriately selected. The blocking of the terminal groups may be effected by use of (C) a monofunctional water-soluble or dispersible organic compound. Such water-soluble or dispersible organic compounds (C) may be those which have one group (functional group) capable of reacting with isocyanate group, e.g. OH group, COOH group, $NH_2$ group, $SO_3H$ group or the like, and may be soluble or dispersible in water. The compounds include, for example, monoalkyl esters and monoalkyl ethers of bifunctional, water-soluble or water-dispersible organic compounds such as polyethylene glycol, polypropylene glycol and the like, and monofunctional organic compounds having a cationic functional group (e.g. a group containing nitrogen) or an anionic functional group (e.g. a group containing a sulfonyl group). Polyethylene glycol monomethyl ether, propylene glycol monomethyl ether, and the like are preferred.

The water-soluble or dispersible organic compound (C) is added such that a mixing ratio (by mole) between the isocyanate groups in the total isocyanates (A) and (B) and the functional groups of the water-soluble or dispersible organic compound capable of reacting with the isocyanate groups is at 1.1:1 to 16:1 (with a theoretical degree, n, of polymerization of carbodiimide being n=0.1 to 15), preferably at 1.5:1 to 11:1 (with the degree, n, of polymerization being n=0.5 to 10), and more preferably, at 2:1 to 6:1 (with the degree, n, of polymerization being n=1 to 5). If the mixing ratio is smaller than 1.1:1, water solubility increases, resulting in poor water resistance. On the contrary, when the ratio exceeds 16:1, water is unlikely to disperse, so that the effect as a crosslinking agent may lower.

The water-soluble or dispersible carbodiimide compound can be prepared by condensation reaction (carbodiimidization reaction) of a mixture of the components (A) and/or (B) and (C) through decarbonation.

The carbodiimidization reaction may be carried out by a known procedure. More particularly, an isocyanate (A) and/or an isocyanate (B), and a monofunctional water-soluble or dispersible organic compound (C) are mixed at given ratios within the above-defined range. A catalyst for carbodiimidization is added to the mixture, which may be dissolved in an inert solvent or may be in a solvent-free condition, in a stream of an inert gas such as nitrogen or under bubbling conditions, followed by heating at a reaction temperature of 150 to 200° C. under agitation, thereby causing the carbodiimidization reaction to proceed. The completion of the reaction is judged by measurement of infrared (IR) absorption spectra, confirming that an absorption of the isocyanate group at a wavelength of 2200 to 2300 $cm^{-1}$ disappears.

The catalysts for carbodiimidization should preferably be organophosphorus compounds. From the standpoint of activity, phosphorene oxides are preferred. Specific examples include 3-methyl-1-phenyl-2-phosphorene-1-oxide, 3-methyl-1-ethyl-2-phosphorene-1-oxide, 1,3-dimethyl-2-phosphorene-1-oxide, 1-phenyl-2-phosphorene-1-oxide, 1-ethyl-2-phosphorene-1-oxide, 1-methyl-2-phosphorene-1-oxide, and double-bond isomers thereof. Of these, industrially, readily available 3-methyl-1-phenyl-2-phosphorene-1-oxide is preferred. The amount of the catalyst usually ranges 0.1 to 10% by weight, preferably from 0.5 to 5% by weight, based on the amount of the total isocyanate compounds.

Alternatively, the carbodiimidization reaction may be carried out, for example, by mixing the monofunctional water-soluble or dispersible organic compound (C) with the isocyanate (B), and, if necessary, agitating in a stream of an inert gas at a temperature ranging from 0 to 200° C. or under bubbling conditions, followed by further addition of the isocyanate (A) along with the catalyst defined above to cause the reaction under agitation.

Still alternatively, the carbodiimide compound having isocyanate groups at terminal ends thereof is prepared by providing an isocyanate mixture of an isocyanate (A) and an isocyanate (B) mixed in an amount of 30% by weight or below based on the isocyanate (A), adding 1 to 10% by weight, based on the total isocyanates, of a catalyst for carbodiimidization after dissolving the mixture in an inert solvent therefor or in a solvent-free condition in a stream of an inert gas such as nitrogen or under bubbling conditions, and heating at a reaction temperature within a range of 150 to 200° C. under agitation thereby causing the carbodiimidization reaction to proceed. Thereafter, a monofunctional, water-soluble or dispersible organic compound (C) is further added in an amount of equivalent to the residual terminal isocyanate groups, followed by mixing with agitation at a temperature ranging from 0 to 200° C., preferably from 60 to 150° C. for 1 to 24 hours, thereby obtaining a carbodiimide compound.

The printing and recording sheet of the present invention is obtained by using a coating or internal additive composition which comprises the crosslinking agent mainly composed of the water-soluble or dispersible carbodiimide compound formulated in a polymer resin. If necessary, the crosslinking agent may, in addition to the water-soluble or dispersible carbodiimide compound, a water-insoluble carbodiimide compound wherein such a condensation reaction product as described hereinbefore is blocked at the terminal isocyanate groups with a hydrophobic group.

If present, the water-insoluble carbodiimide compound should be preferably mixed at a ratio of the water-soluble or dispersible carbodiimide compound prepared from the (A) and/or (B) and (C) components and the water-insoluble carbodiimide being in the range of 100:0 to 30:70 on the weight basis.

The polymer resins include polyvinyl alcohol (PVA) resins, acrylic resins, polyester resins, polyurethane resins, and the like, of which PVA resins are preferred.

The PVA resins may be modified ones including partially saponified, completely saponified, cation-modified, and anion-modified resins. Of these, modified polyvinyl alcohol is preferred, which is obtained by saponifying a copolymer between an ethylenically unsaturated monomer having a carboxyl group, a sulfonate group or an ammonium base and a vinyl ester.

Examples of the ethylenically unsaturated monomer having a carboxyl group include ethylenically unsaturated carboxylic acids, salts thereof, lower alkyl esters thereof or acid anhydrides thereof such as crotonic acid, itaconic acid, monomethyl maleate, acrylic acid, methyl acrylate, maleic anhydride and the like. Examples of the ethylenically unsaturated monomers having a sulfonate group include ethylenically unsaturated sulfonic acids and salts thereof such as vinylsulfonic acid, allylsulfonic acid, N-(meth) acrylamidopropanesulfonic acid, and the like. Examples of the ethylenically unsaturated monomer having an ammonium base include trimethyl-3-(1-(meth)acrylamido-1,1-dimethylpropyl)ammonium chloride, trimethyl-3-(1-(meth) acrylamido-1,1-dimethylethyl)ammonium chloride, trimethyl-3-(1-(meth)acrylamidopropyl)ammonium chloride, N-vinylimidazole, N-vinyl-N-methylimidazole, and quaternarized products thereof. Preferably, the content of the anionic or cationic group moiety in the modified polyvinyl alcohol is in the range of 0.1 to 10 mole %. Depending on the purpose, other types of ethylenically unsaturated monomers may be copolymerized. In this case, the content of the moiety or moieties of other types of ethylenically unsaturated monomers may be within a range which permits the resultant modified PVA to be soluble in water, and is preferably in the range of 0.1 to 10 mole % although depending on the content of ionic group moieties and the degree of saponification.

The degree of saponification of the vinyl acetate units in the modified PVA may depend on the content of the ionic groups and is within a range permitting the resultant PVA to be soluble in water. Usually, the degree is selected from the range of 50 to 100 mole %, preferably 70 to 99 mole %. The degree of polymerization is not critical, and is preferably in the range of 100 to 3,000.

The amount of the crosslinking agent relative to a polymer resin depends on the carbodiimide equivalence (molecular weight of the carbodiimide compound/the number of the carbodiimide group) in the water-soluble or dispersible carbodiimide compound and the type of the carbodiimide compound, and cannot be unconditionally determined. Usually, the amount is in the range of 0.5 to 50 parts by weight, preferably from 1 to 30 parts by weight of a water-soluble or dispersible carbodiimide compound as a solid matter, based on 100 parts by weight of PVA resin. If the amount is less than 0.5 part by weight, satisfactory crosslinkage cannot be attained, and thus, an intended water resistance may not be expected. On the other hand, if the amount exceeds 50 parts by weight, the crosslinking effect is not further improved, which may result in poor economy.

The composition used in the present invention should comprise a polymer resin, such as PVA resin, formulated with such a crosslinking agent as described before. In addition to these components, optional components such as pigments, fillers, plasticizers, dispersants, coating surface-controlling agents, surfactants, UV absorbers, antioxidants and the like may be added to the composition. The amount of these optional components should be within a range not impeding the effect of the invention.

The printing and recording sheet of the invention is obtained by coating the composition onto a support substrate or internal addition of the composition, and crosslinking the composition to form an ink receiving layer. The support substrate is not critical with respect to the type thereof, and may be any ones known in the art, including films of polyethylene terephthalate (PET), polybutylene terephthalate, polyethylene naphthalate, polystyrene, polyvinyl chloride, polymethyl methacrylate, cellulose acetate, polycarbonates, polyimides, celluloid and the like, paper, pigment-coated paper, cloth, wood sheets, metallic sheets, synthetic paper, and the like.

The ink receiving layer is formed on the support substrate, for example, by a method wherein a mixed aqueous solution or dispersion of PVA resin and the crosslinking agent of the present invention, to which a filler may be added, if necessary, is impregnated in the substrate according to an ordinary coating technique such as size pressing, air knife coating, roll coating, bar coating, blade coating, dip coating or the like. If non-woven fabric or paper is used as the substrate, the mixed aqueous solution or dispersion containing the crosslinking agent may be internally added to a paper-making raw material.

After completion of the coating, dipping or internal addition by the above-mentioned method, the composition is dried at a temperature of 0 to 180° C., preferably 20 to 120° C. and more preferably 30 to 80° C., to crosslink the polymer resin and obtain a printing and recording sheet of the present invention having an ink receiving layer with good adhesion to the substrate. The amount of coating, dipping or internal addition of the aqueous solution or dispersion of the composition is usually in the range of 0.1 to 200 g/m$^2$, preferably from 1 to 100 g/m$^2$, relative to the support substrate. If the amount is less than 0.1 g/m$^2$, the ink receiving ability may not develop satisfactorily. On the contrary, when the amount exceeds 200 g/m$^2$, not only the effect does not develop, but also such a large amount may not be economical.

In order to further improve the ink receiving ability of the sheet, it is possible to add various types of fillers to the coating, dipping or internal additive solution beforehand. Such fillers include silica, clay, talc, kaolin, diatomaceous earth, calcium carbonate, calcium sulfate, satin white, aluminium silicate, alumina, zeolite, fibrilated cellulose, crystalline cellulose, calcium alginate, carbodiimide powder, starch, various types of oxidized starch, gelatin, metal stearates (sodium, potassium, calcium, zinc and the like stearates), aluminium sulfate, rosin, smectite, and the like. These may be used singly or in combination. The amount of the filler is such that after coating, dipping or internal addition, and drying, the filler does not drop off from the resultant sheet in an ordinary way of using the sheet. The amount is in the range of 0 to 500 parts by weight, preferably from 1 to 500 parts by weight, more preferably 1 to 100 parts by weight, per 100 parts by weight of PVA resin (ink receiving resin).

The printing and recording sheet of the present invention enables better recording and printing when applied to an ink jet recording system. The sheet has a good water resistance, a reduced degree of blotting, and good ink absorbency, and thus, a clear image can be obtained. To this end, paper is preferred as a material to be recorded. Direct printing on transparent films made of various types of plastics, such as polyethylene terephthalate (PET), polypropylene, polyethylene, nylons and the like, may be possible for use as OHP sheets or for observation of transmitted light such as through color displays.

EXAMPLE

The invention is more particularly described by way of Synthetic Examples and Examples, which should not be construed as limiting the invention thereto. Comparative examples are also described.

Synthetic Example 1

As shown in Table 1, 1682 g of hexamethylene diisocyanate (HDI) and 2200 g of polyethylene glycol monomethyl ether (M400, with an average molecular weight of 400) were placed in a 20-liter reaction vessel equipped with a reflux condenser and an agitator, and mechanically agitated at 120° C. for 1 hour. Further, 262 g of 4,4'-dicyclohexyl-methane diisocyanate (HMDI) and 38.8 g (2% by weight based on the total amount of the isocyanates) of 3-methyl-1-phenyl-2-phosphorene-1-oxide used as a catalyst for carbodiimidization were added to the mixture, followed by further agitation in a stream of nitrogen at 185° C. for 5 hours. The completion of reaction was judged by measurement of infrared (IR) absorption spectra, through which an absorption of the isocyanate group at a wavelength of 2200 to 2300 cm$^{-1}$ was confirmed to disappear.

After the completion of the reaction, the reaction system was allowed to cool down to 60° C., to which distilled water was added so that the resin solid component was at a level of 5671 g (40% by weight), thereby preparing a carbodiimide compound of Synthetic Example 1.

It will be noted that in Tables 1 to 15, the degree of polymerization indicates a theoretical degree of polymerization of each of the resulting carbodiimide compounds.

Synthetic Examples 2 to 5

Carbodiimide compounds of Synthetic Examples 2 to 5 were, respectively, prepared under the same conditions as in Synthetic Example 1 except that the amounts of HDI and M400 being mixed were changed as shown in Table 1.

TABLE 1

| Synthetic Example | HDI (g) | HMDI (g) | M400 (g) | Degree of Polymerization (n) | HDI:HMDI (Molar Ratio) |
|---|---|---|---|---|---|
| 1 | 1682 | 262 | 2200 | 3 | 10:1 |
| 2 | 841 | 262 | 800 | 4 | 5:1 |
| 3 | 505 | 262 | 800 | 3 | 3:1 |
| 4 | 168 | 262 | 800 | 1 | 1:1 |
| 5 | 168 | 262 | 400 | 3 | 1:1 |

Synthetic Examples 6 to 10

Carbodiimide compounds of Synthetic Examples 6 to 10 were, respectively, prepared under the same conditions as in Synthetic Example 1 according to the formulations shown in Table 2 wherein hydrogenated xylylene diisocyanate ($H_6$XDI) was used in place of HDI in Synthetic Example 1.

TABLE 2

| Synthetic Example | $H_6$XDI (g) | HMDI (g) | M400 (g) | Degree of Polymerization (n) | $H_6$XDI:HMDI (Molar Ratio) |
|---|---|---|---|---|---|
| 6 | 1942 | 262 | 2200 | 3 | 10:1 |
| 7 | 971 | 262 | 800 | 4 | 5:1 |
| 8 | 583 | 262 | 800 | 3 | 3:1 |
| 9 | 194 | 262 | 800 | 1 | 1:1 |
| 10 | 194 | 262 | 400 | 3 | 1:1 |

Synthetic Examples 11 to 15

Carbodiimide compounds of Synthetic Examples 11 to 15 were, respectively, prepared under the same conditions as in Synthetic Example 1 according to the formulations shown in Table 3 wherein xylylene diisocyanate (XDI) was used in place of HDI in Synthetic Example 1.

TABLE 3

| Synthetic Example | XDI (g) | HMDI (g) | M400 (g) | Degree of Polymerization (n) | XDI:HMDI (Molar Ratio) |
|---|---|---|---|---|---|
| 11 | 1882 | 262 | 2200 | 3 | 10:1 |
| 12 | 941 | 262 | 800 | 4 | 5:1 |
| 13 | 565 | 262 | 800 | 3 | 3:1 |
| 14 | 188 | 262 | 800 | 1 | 1:1 |
| 15 | 188 | 262 | 400 | 3 | 1:1 |

Synthetic Examples 16 to 20

Carbodiimide compounds of Synthetic Examples 16 to 20 were, respectively, prepared under the same conditions as in Synthetic Example 1 according to the formulations shown in Table 4 wherein 2,2,4-trimethylhexamethylene diisocyanate (TMHDI) was used in place of HDI in Synthetic Example 1.

TABLE 4

| Synthetic Example | TMHDI (g) | HMDI (g) | M400 (g) | Degree of Polymerization (n) | TMHDI:HMDI (Molar Ratio) |
|---|---|---|---|---|---|
| 16 | 2100 | 262 | 2200 | 3 | 10:1 |
| 17 | 1050 | 262 | 800 | 4 | 5:1 |
| 18 | 630 | 262 | 800 | 3 | 3:1 |
| 19 | 210 | 262 | 800 | 1 | 1:1 |
| 20 | 210 | 262 | 400 | 3 | 1:1 |

Examples 21 to 25

Carbodiimide compounds of Synthetic Examples 21 to 25 were, respectively, prepared under the same conditions as in Synthedtic Example 1 according to the formulations shown in Table 5 wherein norbornane diisocyanate (NBDI) was used in place of HDI in Synthetic Example 1.

TABLE 5

| Synthetic Example | NBDI (g) | HMDI (g) | M400 (g) | Degree of Polymerization (n) | NBDI:HMDI (Molar Ratio) |
|---|---|---|---|---|---|
| 21 | 2062 | 262 | 2200 | 3 | 10:1 |
| 22 | 1031 | 262 | 800 | 4 | 5:1 |
| 23 | 619 | 262 | 800 | 3 | 3:1 |
| 24 | 206 | 262 | 800 | 1 | 1:1 |
| 25 | 206 | 262 | 400 | 3 | 1:1 |

Synthetic Examples 26 to 30

Carbodiide compounds of Synthetic Examples 26 to 30 were, respectively, prepared under the same conditions as in Synthetic Example 1 according to the formulations shown in Table 6 wherein isophorone diisocyanate (IPDI) was used in place of HDI in Synthetic Example 1.

TABLE 6

| Synthetic Example | HDI (g) | IPDI (g) | M400 (g) | Degree of Polymerization (n) | HDI:IPDI (Molar Ratio) |
|---|---|---|---|---|---|
| 26 | 1682 | 222 | 2200 | 3 | 10:1 |
| 27 | 841 | 222 | 600 | 4 | 5:1 |
| 28 | 505 | 222 | 800 | 3 | 3:1 |
| 29 | 168 | 222 | 800 | 1 | 1:1 |
| 30 | 168 | 222 | 400 | 3 | 1:1 |

Synthetic Examples 31 to 35

Carbodiimide compounds of Synthetic Examples 31 to 35 were, respectively, prepared under the same conditions as in Synthetic Example 1 according to the formulations shown in Table wherein IPDI was used in place of HMDI in Synthetic Example 6.

TABLE 7

| Synthetic Example | $H_6$XDI (g) | IPDI (g) | M400 (q) | Degree of Polymerization (n) | $H_6$XDI:IPDI (Molar Ratio) |
|---|---|---|---|---|---|
| 31 | 1942 | 222 | 2200 | 3 | 10:1 |
| 32 | 971 | 222 | 800 | 4 | 5:1 |
| 33 | 583 | 222 | 800 | 3 | 3:1 |
| 34 | 194 | 222 | 800 | 1 | 1:1 |
| 35 | 194 | 222 | 400 | 3 | 1:1 |

Synthetic Examples 36 to 40

Carbodiide compounds of Synthetic Examples 36 to 40 were, respectively, prepared under the same conditions as in Synthetic Example 1 according to the formulations shown in Table 8 wherein IPDI was used in place of HMDI in Synthetic Example 11.

TABLE 8

| Synthetic Example | XDI (g) | IPDI (g) | M400 (g) | Degree of Polymerization (n) | XDI:IPDI (Molar Ratio) |
|---|---|---|---|---|---|
| 36 | 1882 | 222 | 2200 | 3 | 10:1 |
| 37 | 941 | 222 | 800 | 4 | 5:1 |
| 38 | 565 | 222 | 800 | 3 | 3:1 |
| 39 | 188 | 222 | 800 | 1 | 1:1 |
| 40 | 188 | 222 | 400 | 3 | 1:1 |

Synthetic Examples 41 to 45

Carbodiimide compounds of Synthetic Examples 41 to 45 were, respectively, prepared under the same conditions as in Synthetic Example 1 according to the formulations shown in Table 9 wherein IPDI was used in place of HMDI in Synthetic Example 16.

TABLE 9

| Synthetic Example | TMHDI (g) | IPDI (g) | M400 (g) | Degree of Polymerization (n) | TMHDI:IPDI (Molar Ratio) |
|---|---|---|---|---|---|
| 41 | 2100 | 222 | 2200 | 3 | 10:1 |
| 42 | 1050 | 222 | 800 | 4 | 5:1 |
| 43 | 630 | 222 | 800 | 3 | 3:1 |
| 44 | 210 | 222 | 800 | 1 | 1:1 |
| 45 | 210 | 222 | 400 | 3 | 1:1 |

Synthetic Examples 46 to 50

Carbodiimide compounds of Synthetic Examples 46 to 50 were prepared under the same conditions as in Synthetic Example 1 according to the formulations shown in Table 10 wherein IPDI was used in place of HMDI in Synthetic Example 21.

TABLE 10

| Synthetic Example | NBDI (g) | IPDI (g) | M400 (g) | Degree of Polymerization (n) | NBDI:IPDI (Molar Ratio) |
|---|---|---|---|---|---|
| 46 | 2062 | 222 | 2200 | 3 | 10:1 |
| 47 | 1031 | 222 | 800 | 4 | 5:1 |
| 48 | 619 | 222 | 800 | 3 | 3:1 |
| 49 | 206 | 222 | 800 | 1 | 1:1 |
| 50 | 206 | 222 | 400 | 3 | 1:1 |

Synthetic Examples 51 to 55

Carbodiimide compounds of Synthetic Examples 51 to 55 were, respectively, prepared under the same conditions as in Synthetic Example 1 according to the formulations shown in Table 11 wherein TMXDI was used in place of HMDI in Synthetic Example 1.

TABLE 11

| Synthetic Example | HDI (g) | TMXDI (g) | M400 (g) | Degree of Polymerization (n) | HDI:TMXDI (Molar Ratio) |
|---|---|---|---|---|---|
| 51 | 1682 | 244 | 2200 | 3 | 10:1 |
| 52 | 841 | 244 | 800 | 4 | 5:1 |
| 53 | 505 | 244 | 800 | 3 | 3:1 |
| 54 | 168 | 244 | 800 | 1 | 1:1 |
| 55 | 168 | 244 | 400 | 3 | 1:1 |

Synthetic Examples 56 to 60

Carbodiimide compounds of Synthetic Examples 56 to 60 were, respectively, prepared under the same conditions as in Synthetic Example 1 according to the formulations shown in Table 12 wherein TMXDI was used in place of HMDI in Synthetic Example 6.

TABLE 12

| Synthetic Example | $H_6XDI$ (g) | TMXDI (g) | M400 (g) | Degree of Polymerization (n) | $H_6XDI$:TMXDI (Molar Ratio) |
|---|---|---|---|---|---|
| 56 | 1942 | 244 | 2200 | 3 | 10:1 |
| 57 | 971 | 244 | 800 | 4 | 5:1 |
| 58 | 583 | 244 | 800 | 3 | 3:1 |
| 59 | 194 | 244 | 800 | 1 | 1:1 |
| 60 | 194 | 244 | 400 | 3 | 1:1 |

Synthetic Examples 61 to 65

Carbodiimide compounds of Synthetic Examples 61 to 65 were, respectively, prepared under the same conditions as in Synthetic Example 1 according to the formulations shown in Table 13 wherein TMXDI was used in place of HMDI in Synthetic Example 11.

TABLE 13

| Synthetic Example | XDI (g) | TMXDI (g) | M400 (g) | Degree of Polymerization (n) | XDI:TMXDI (Molar Ratio) |
|---|---|---|---|---|---|
| 61 | 1882 | 244 | 2200 | 3 | 10:1 |
| 62 | 941 | 244 | 800 | 4 | 5:1 |
| 63 | 565 | 244 | 800 | 3 | 3:1 |
| 64 | 188 | 244 | 800 | 1 | 1:1 |
| 65 | 188 | 244 | 400 | 3 | 1:1 |

Synthetic Examples 66 to 70

Carbodiimide compounds of Synthetic Examples 66 to 70 were, respectively, prepared under the same conditions as in Synthetic Example 1 according to the formulations shown in Table 14 wherein TMXDI was used in place of HMDI in Synthetic Example 16.

TABLE 14

| Synthetic Example | TMHDI (g) | TMXDI (g) | M400 (g) | Degree of Polymerization (n) | TMHDI:TMXDI (Molar Ratio) |
|---|---|---|---|---|---|
| 66 | 2100 | 244 | 2200 | 3 | 10:1 |
| 67 | 1050 | 244 | 800 | 4 | 5:1 |
| 68 | 630 | 244 | 800 | 3 | 3:1 |
| 69 | 210 | 244 | 800 | 1 | 1:1 |
| 70 | 210 | 244 | 400 | 3 | 1:1 |

Synthetic Examples 71 to 75

Carbodiimide compounds of Synthetic Examples 71 to 75 were, respectively, prepared under the same conditions as in Synthetic Example 1 according to the formulations shown in Table 15 wherein TMXDI was used in place of HMDI in Synthetic Example 21.

TABLE 15

| Synthetic Example | NBDI (g) | TMXDI (g) | M400 (g) | Degree of Polymerization (n) | NBDI:TMXDI (Molar Ratio) |
|---|---|---|---|---|---|
| 71 | 2062 | 244 | 2200 | 3 | 10:1 |
| 72 | 1031 | 244 | 800 | 4 | 5:1 |
| 73 | 619 | 244 | 800 | 3 | 3:1 |
| 74 | 206 | 244 | 800 | 1 | 1:1 |
| 75 | 206 | 244 | 400 | 3 | 1:1 |

TABLE 16

| Synthetic Example | HMDI (g) | TMXDI (g) | IPDI (g) | M400 (g) | Degree of Polymerization (n) | Amount of Catalyst (g) |
|---|---|---|---|---|---|---|
| 76 | 1048 | | | 800 | 3 | 10.5 |
| 77 | 1572 | | | 800 | 5 | 15.7 |
| 78 | | 976 | | 800 | 3 | 19.5 |
| 79 | | 1952 | | 800 | 7 | 39.0 |
| 80 | | | 888 | 800 | 3 | 8.9 |
| 81 | | | 1332 | 800 | 5 | 13.3 |

Synthetic Example 76

As shown in Table 16, 1048 g of HMDI and 10.5 g (1% by weight based on the total of the isocyanates) of a catalyst for carbodiimidization (3-methyl-1-phenyl-2-phosphorene-1-oxide) were charged into a 5000 ml reaction vessel equipped with a reflux condenser and an agitator, followed by agitation in a stream of nitrogen at 185 ° C. for 10 hours. The reation vessel was allowed to cool down to 120° C., to which 800 g of 400 was added, followed by reaction for 1 hour while agitating at the same temperature, and again heating to 150° C., at which the reaction was caused to proceed for 5 hours under agitation. The completion of reaction was judged by measurement of infrared (IR) absorption spectra, through which an absorption of the isocyanate group at a wavelength of 2200 to 2300 $cm^{-1}$ was confirmed to disappear.

After the completion of the reaction, the reaction system was allowed to cool down to 60° C., to which distilled water was added so that the resin solid component was at a level of 2242 g (40% by weight), thereby obtaining a carbodiimide compound of Synthetic Example 76.

Synthetic Examples 77 to 81

Carbodiimide compounds of Synthetic Examples 77 to 81 were, respectively, prepared under the same conditions as in Synthetic Example 76 according to the formulations shown in Table 16.

Synthetic Example 82

As shown in Table 17, 673 g of HDI and 800 g of M400 were charged into a 5 liters reaction vessel equipped with a reflux condenser and an agitator, followed by mixing under mechanical agitation. Moreover, 13.5 g (2% by weight based on the total of the isocyanates) of a catalyst for carbodiimidization (3-methyl-1-phenyl-2-phosphorene-1-oxide) was added to the mixture, followed by agitation in a stream of nitrogen at 185° C. for further 5 hours. The completion of the reaction was judged by the measurement of infrared (IR) absorption ra, through which an absorption of the isocyanate group at a wavelength of 2200 to 2300 $cm^{-1}$ was confirmed to disappear.

after the completion of the reaction, the reaction system was allowed to cool down to 60° C., to which distilled water was added so that the resin solid component was at a level of 2011 g (40% by weight), thereby obtaining a carbodiimide compound of Synthetic Example 82.

Synthetic Examples 83 to 89

Carbodiimide compounds of Synthetic Examples 83 to 89 were, respectively, prepared under the same conditions as in Synthetic Example 82 according to the formulations shown in Table 17,

TABLE 17

| Synthetic Example | HDI (g) | $H_6XDI$ (g) | XDI (g) | NBDI (g) | M400 (g) | Degree of Polymerization (n) | Amount of Catalyst (g) |
|---|---|---|---|---|---|---|---|
| 82 | 673 | | | | 800 | 3 | 13.5 |
| 83 | 1008 | | | | 800 | 5 | 20.2 |
| 84 | | 777 | | | 800 | 3 | 15.5 |
| 85 | | 1165 | | | 800 | 5 | 23.3 |
| 86 | | | 753 | | 800 | 3 | 15.1 |
| 87 | | | 1129 | | 800 | 5 | 22.6 |
| 88 | | | | 824 | 800 | 3 | 16.5 |
| 89 | | | | 1236 | 800 | 5 | 24.7 |

Synthetic Example 90

As shown in Table 18, 696 g of TDI and 800 g of M400 were charged into a 5000 ml reaction vessel equipped with a reflux condenser and an agitator, and agitated at 50° C. for 1 hour under mechanical agitation, followed by addition of 7.0 g (1% by weight based on the total of the isocyanates) of a catalyst for carbodiimidization (3-methyl-1-phenyl-2-phosphorene-1-oxide) and agitation in a stream of nitrogen at 80° C. for further 5 hours. The completion of the reaction was judged by the measurement of infrared (IR) absorption spectra, through which an absorption of the isocyanate group at a wavelength of 2200 to 2300 $cm^{-1}$ was confirmed to disappear.

After the completion of the reaction, the reaction system was allowed to cool down to 60° C., to which distilled water was added so that the resin solid component was at a level of 2057 g (40% by weight), thereby preparing a carbodiimide compound of Synthetic Example 90.

Synthetic Examples 91 to 93

Carbodiimide compounds of Synthetic Examples 91 to 93 were, respectively, prepared under the same conditions as in Synthetic Example 90 according to the formulations shown in Table 18.

TABLE 18

| Synthetic Example | TDI (g) | MDI (g) | M400 (g) | Degree of Polymerization (n) | Amount of Catalyst (g) |
|---|---|---|---|---|---|
| 90 | 696 | | 800 | 3 | 7.0 |
| 91 | 1044 | | 800 | 5 | 10.4 |
| 92 | | 1000 | 800 | 3 | 10.0 |
| 93 | | 1500 | 800 | 5 | 15.0 |

Example 1

Polyvinyl alcohol (PVA) resin, KL-318 (Kurare Co., Ltd.), was dissolved in distilled water to make a 10% resin aqueous solution. 5 parts by weight or 10 parts by weight of each of the carbodiimide compounds obtained in Synthetic Examples 1 to 93 as a resin component was added to 1000 parts by weight (with 100 parts by weight of the solid matter, i.e. PVA resin) of the solution, and was well mixed under agitation to obtain resin mixtures.

100 parts by weight of colloidal silica (Snowtex YL, available from Nissan Chemical Industries, Ltd.) was added to 30 parts by weight of the solid matter of the resin mixture, followed by coating onto a PET sheet by means of a bar coater having a gap of 100 μm and curing at 40° C. for 24 hours to obtain test recording sheet Nos. 1 to 93.

Example 2

A slurry composed of 91 parts by weight of a pulp slurry, 0.8 part by weight of cationized starch, 0.4 part by weight of aluminium sulfate, 9 parts by weight of kaolin, and 0.1 part by weight of alkylketene dimer and having a pH of 8.2 was run on a Fourdrinier paper machine, dried and calendered to obtain a stock paper having a basis weight of 85 $g/m^2$. This paper had a Stockigt sizing degree of 25 seconds.

Test recording paper Nos. 1 to 93 were, respectively, prepared under the same conditions as in Example 1 except that the stock paper was used in place of the PET sheet.

Comparative Example 1

The procedure of Example 1 was repeated without addition of any carbodiimide compound, thereby obtaining test recording sheets.

Comparative Example 2

The procedure of Example 2 was repeated without addition of any carbodiimide compound, thereby obtaining test recording sheets.

The sheets of Examples 1, 2 and Comparative Examples 1, 2 were each subjected to an ink jet recording test in the following manner. The results are shown in Tables 19 to 25.

Ink Jet Recording Test

The following four inks a to d were used for ink jet recording on the test sheets or papers under recording conditions of an ink droplet diameter of 90 μm and a pixel size of 300×300. The thus recorded sheet was evaluated with respect to the water resistance, degree of blotting, and ink absorbency determined according to the following methods.

| | |
|---|---|
| a. Yellow ink (composition) | |
| C.I. Acid Yellow 23 | 2 parts by weight |
| Diethylene glycol | 30 parts by weight |
| Water | 70 parts by weight |
| b. Magenta ink (composition) | |
| C.I. Acid Red 92 | 2 parts by weight |
| Diethylene glycol | 30 parts by weight |
| Water | 70 parts by weight |
| c. Cyan ink (composition) | |
| C.I. Direct Blue 86 | 2 parts by weight |
| Diethylene glycol | 30 parts by weight |
| Water | 70 parts by weight |
| d. Black ink (composition) | |
| C.I. Direct Black 19 | 2 parts by weight |
| Diethylene glycol | 30 parts by weight |
| Water | 70 parts by weight |

Water Resistance

Water was dropped on each recorded sheet, and after rubbing with a finger, the state of the print on the sheet was observed to evaluate according to the following five ranks.

5: no change

4: slight degree of blotting

3: appreciable degree of blotting

2: film partly dissolved out

1: film fully dissolved out

Degree of Blotting

The diameter of printed dots on each sheet was measured by means of a stereoscopic microscope, and was indicated by a magnification relative to the diameter of ink droplet (90 μm). A lower magnification shows a less degree of blotting.

Ink Absorbency

The printing sheet was printed with different inks which were superposed with one another, and a degree of flow-out of the inks and a clarity of printed images were evaluated according to the following standards.

3: no flow-out of inks with clear images

2: images slightly blurred

1: images not clear

TABLE 19

[Example 1] Water Resistance

| No. | 5 parts | 10 parts |
|---|---|---|
| 1 | 5 | 5 |
| 2 | 5 | 5 |
| 3 | 5 | 5 |
| 4 | 5 | 5 |
| 5 | 5 | 5 |
| 6 | 5 | 5 |
| 7 | 5 | 5 |
| 8 | 5 | 5 |
| 9 | 5 | 5 |
| 10 | 5 | 5 |
| 11 | 5 | 5 |

TABLE 19-continued

| [Example 1] Water Resistance | | |
|---|---|---|
| No. | 5 parts | 10 parts |
| 12 | 5 | 5 |
| 13 | 5 | 5 |
| 14 | 5 | 5 |
| 15 | 5 | 5 |
| 16 | 5 | 5 |
| 17 | 5 | 5 |
| 18 | 5 | 5 |
| 19 | 5 | 5 |
| 20 | 5 | 5 |
| 21 | 5 | 5 |
| 22 | 5 | 5 |
| 23 | 5 | 5 |
| 24 | 5 | 5 |
| 25 | 5 | 5 |
| 26 | 5 | 5 |
| 27 | 5 | 5 |
| 28 | 5 | 5 |
| 29 | 5 | 5 |
| 30 | 5 | 5 |
| 31 | 5 | 5 |
| 32 | 5 | 5 |
| 33 | 5 | 5 |
| 34 | 5 | 5 |
| 35 | 5 | 5 |
| 36 | 5 | 5 |
| 37 | 5 | 5 |
| 38 | 5 | 5 |
| 39 | 5 | 5 |
| 40 | 5 | 5 |
| 41 | 5 | 5 |
| 42 | 5 | 5 |
| 43 | 5 | 5 |
| 44 | 5 | 5 |
| 45 | 5 | 5 |
| 46 | 5 | 5 |
| 47 | 5 | 5 |
| 48 | 5 | 5 |
| 49 | 5 | 5 |
| 50 | 5 | 5 |
| 51 | 4 | 5 |
| 52 | 4 | 5 |
| 53 | 4 | 5 |
| 54 | 4 | 5 |
| 55 | 4 | 5 |
| 56 | 4 | 5 |
| 57 | 4 | 5 |
| 58 | 4 | 5 |
| 59 | 4 | 5 |
| 60 | 4 | 5 |
| 61 | 4 | 5 |
| 62 | 4 | 5 |
| 63 | 4 | 5 |
| 64 | 4 | 5 |
| 65 | 4 | 5 |
| 66 | 4 | 5 |
| 67 | 4 | 5 |
| 68 | 4 | 5 |
| 69 | 4 | 5 |
| 70 | 4 | 5 |
| 71 | 4 | 5 |
| 72 | 4 | 5 |
| 73 | 4 | 5 |
| 74 | 4 | 5 |
| 75 | 4 | 5 |
| 76 | 4 | 4 |
| 77 | 4 | 4 |
| 78 | 4 | 4 |
| 79 | 4 | 4 |
| 80 | 4 | 4 |
| 81 | 4 | 4 |
| 82 | 4 | 5 |
| 83 | 4 | 5 |
| 84 | 4 | 5 |
| 85 | 4 | 5 |
| 86 | 4 | 5 |

TABLE 19-continued

| [Example 1] Water Resistance | | |
|---|---|---|
| No. | 5 parts | 10 parts |
| 87 | 4 | 5 |
| 88 | 4 | 5 |
| 89 | 4 | 5 |
| 90 | 4 | 5 |
| 91 | 4 | 5 |
| 92 | 4 | 5 |
| 93 | 4 | 5 |

TABLE 20

| [Example 1] Degree of Blotting | | |
|---|---|---|
| No. | 5 parts | 10 parts |
| 1 | 2 | 2 |
| 2 | 2 | 2 |
| 3 | 2 | 2 |
| 4 | 2 | 2 |
| 5 | 2 | 2 |
| 6 | 2 | 2 |
| 7 | 2 | 2 |
| 8 | 2 | 2 |
| 9 | 2 | 2 |
| 10 | 2 | 2 |
| 11 | 2 | 2 |
| 12 | 2 | 2 |
| 13 | 2 | 2 |
| 14 | 2 | 2 |
| 15 | 2 | 2 |
| 16 | 2 | 2 |
| 17 | 2 | 2 |
| 18 | 2 | 2 |
| 19 | 2 | 2 |
| 20 | 2 | 2 |
| 21 | 2 | 2 |
| 22 | 2 | 2 |
| 23 | 2 | 2 |
| 24 | 2 | 2 |
| 25 | 2 | 2 |
| 26 | 2 | 2 |
| 27 | 2 | 2 |
| 28 | 2 | 2 |
| 29 | 2 | 2 |
| 30 | 2 | 2 |
| 31 | 2 | 2 |
| 32 | 2 | 2 |
| 33 | 2 | 2 |
| 34 | 2 | 2 |
| 35 | 2 | 2 |
| 36 | 2 | 2 |
| 37 | 2 | 2 |
| 38 | 2 | 2 |
| 39 | 2 | 2 |
| 40 | 2 | 2 |
| 41 | 2 | 2 |
| 42 | 2 | 2 |
| 43 | 2 | 2 |
| 44 | 2 | 2 |
| 45 | 2 | 2 |
| 46 | 2 | 2 |
| 47 | 2 | 2 |
| 48 | 2 | 2 |
| 49 | 2 | 2 |
| 50 | 2 | 2 |
| 51 | 2 | 2 |
| 52 | 2 | 2 |
| 53 | 2 | 2 |
| 54 | 2 | 2 |
| 55 | 2 | 2 |
| 56 | 2 | 2 |
| 57 | 2 | 2 |
| 58 | 2 | 2 |

TABLE 20-continued

| [Example 1] Degree of Blotting | | |
|---|---|---|
| No. | 5 parts | 10 parts |
| 59 | 2 | 2 |
| 60 | 2 | 2 |
| 61 | 2 | 2 |
| 62 | 2 | 2 |
| 63 | 2 | 2 |
| 64 | 2 | 2 |
| 65 | 2 | 2 |
| 66 | 2 | 2 |
| 67 | 2 | 2 |
| 68 | 2 | 2 |
| 69 | 2 | 2 |
| 70 | 2 | 2 |
| 71 | 2 | 2 |
| 72 | 2 | 2 |
| 73 | 2 | 2 |
| 74 | 2 | 2 |
| 75 | 2 | 2 |
| 76 | 2 | 2 |
| 77 | 2 | 2 |
| 78 | 2 | 2 |
| 79 | 2 | 2 |
| 80 | 2 | 2 |
| 81 | 2 | 2 |
| 82 | 2 | 2 |
| 83 | 2 | 2 |
| 84 | 2 | 2 |
| 85 | 2 | 2 |
| 86 | 2 | 2 |
| 87 | 2 | 2 |
| 88 | 2 | 2 |
| 89 | 2 | 2 |
| 90 | 2 | 2 |
| 91 | 2 | 2 |
| 92 | 2 | 2 |
| 93 | 2 | 2 |

TABLE 21

| [Example 1] Ink Absorbency | | |
|---|---|---|
| No. | 5 parts | 10 parts |
| 1 | 3 | 3 |
| 2 | 3 | 3 |
| 3 | 3 | 3 |
| 4 | 3 | 3 |
| 5 | 3 | 3 |
| 6 | 3 | 3 |
| 7 | 3 | 3 |
| 8 | 3 | 3 |
| 9 | 3 | 3 |
| 10 | 3 | 3 |
| 11 | 3 | 3 |
| 12 | 3 | 3 |
| 13 | 3 | 3 |
| 14 | 3 | 3 |
| 15 | 3 | 3 |
| 16 | 3 | 3 |
| 17 | 3 | 3 |
| 18 | 3 | 3 |
| 19 | 3 | 3 |
| 20 | 3 | 3 |
| 21 | 3 | 3 |
| 22 | 3 | 3 |
| 23 | 3 | 3 |
| 24 | 3 | 3 |
| 25 | 3 | 3 |
| 26 | 3 | 3 |
| 27 | 3 | 3 |
| 28 | 3 | 3 |
| 29 | 3 | 3 |
| 30 | 3 | 3 |

TABLE 21-continued

| [Example 1] Ink Absorbency | | |
|---|---|---|
| No. | 5 parts | 10 parts |
| 31 | 3 | 3 |
| 32 | 3 | 3 |
| 33 | 3 | 3 |
| 34 | 3 | 3 |
| 35 | 3 | 3 |
| 36 | 3 | 3 |
| 37 | 3 | 3 |
| 38 | 3 | 3 |
| 39 | 3 | 3 |
| 40 | 3 | 3 |
| 41 | 3 | 3 |
| 42 | 3 | 3 |
| 43 | 3 | 3 |
| 44 | 3 | 3 |
| 45 | 3 | 3 |
| 46 | 3 | 3 |
| 47 | 3 | 3 |
| 48 | 3 | 3 |
| 49 | 3 | 3 |
| 50 | 3 | 3 |
| 51 | 3 | 3 |
| 52 | 3 | 3 |
| 53 | 3 | 3 |
| 54 | 3 | 3 |
| 55 | 3 | 3 |
| 56 | 3 | 3 |
| 57 | 3 | 3 |
| 58 | 3 | 3 |
| 59 | 3 | 3 |
| 60 | 3 | 3 |
| 61 | 3 | 3 |
| 62 | 3 | 3 |
| 63 | 3 | 3 |
| 64 | 3 | 3 |
| 65 | 3 | 3 |
| 66 | 3 | 3 |
| 67 | 3 | 3 |
| 68 | 3 | 3 |
| 69 | 3 | 3 |
| 70 | 3 | 3 |
| 71 | 3 | 3 |
| 72 | 3 | 3 |
| 73 | 3 | 3 |
| 74 | 3 | 3 |
| 75 | 3 | 3 |
| 76 | 3 | 3 |
| 77 | 3 | 3 |
| 78 | 3 | 3 |
| 79 | 3 | 3 |
| 80 | 3 | 3 |
| 81 | 3 | 3 |
| 82 | 3 | 3 |
| 83 | 3 | 3 |
| 84 | 3 | 3 |
| 85 | 3 | 3 |
| 86 | 3 | 3 |
| 87 | 3 | 3 |
| 88 | 3 | 3 |
| 89 | 3 | 3 |
| 90 | 3 | 3 |
| 91 | 3 | 3 |
| 92 | 3 | 3 |
| 93 | 3 | 3 |

TABLE 22

| [Example 2] Water Resistance | | |
|---|---|---|
| No. | 5 parts | 10 parts |
| 1 | 5 | 5 |
| 2 | 5 | 5 |

TABLE 22-continued

[Example 2] Water Resistance

| No. | 5 parts | 10 parts |
|---|---|---|
| 3 | 5 | 5 |
| 4 | 5 | 5 |
| 5 | 5 | 5 |
| 6 | 5 | 5 |
| 7 | 5 | 5 |
| 8 | 5 | 5 |
| 9 | 5 | 5 |
| 10 | 5 | 5 |
| 11 | 5 | 5 |
| 12 | 5 | 5 |
| 13 | 5 | 5 |
| 14 | 5 | 5 |
| 15 | 5 | 5 |
| 16 | 5 | 5 |
| 17 | 5 | 5 |
| 18 | 5 | 5 |
| 19 | 5 | 5 |
| 20 | 5 | 5 |
| 21 | 5 | 5 |
| 22 | 5 | 5 |
| 23 | 5 | 5 |
| 24 | 5 | 5 |
| 25 | 5 | 5 |
| 26 | 5 | 5 |
| 27 | 5 | 5 |
| 28 | 5 | 5 |
| 29 | 5 | 5 |
| 30 | 5 | 5 |
| 31 | 5 | 5 |
| 32 | 5 | 5 |
| 33 | 5 | 5 |
| 34 | 5 | 5 |
| 35 | 5 | 5 |
| 36 | 5 | 5 |
| 37 | 5 | 5 |
| 38 | 5 | 5 |
| 39 | 5 | 5 |
| 40 | 5 | 5 |
| 41 | 5 | 5 |
| 42 | 5 | 5 |
| 43 | 5 | 5 |
| 44 | 5 | 5 |
| 45 | 5 | 5 |
| 46 | 5 | 5 |
| 47 | 5 | 5 |
| 48 | 5 | 5 |
| 49 | 5 | 5 |
| 50 | 5 | 5 |
| 51 | 4 | 5 |
| 52 | 4 | 5 |
| 53 | 4 | 5 |
| 54 | 4 | 5 |
| 55 | 4 | 5 |
| 56 | 4 | 5 |
| 57 | 4 | 5 |
| 58 | 4 | 5 |
| 59 | 4 | 5 |
| 60 | 4 | 5 |
| 61 | 4 | 5 |
| 62 | 4 | 5 |
| 63 | 4 | 5 |
| 64 | 4 | 5 |
| 65 | 4 | 5 |
| 66 | 4 | 5 |
| 67 | 4 | 5 |
| 68 | 4 | 5 |
| 69 | 4 | 5 |
| 70 | 4 | 5 |
| 71 | 4 | 5 |
| 72 | 4 | 5 |
| 73 | 4 | 5 |
| 74 | 4 | 5 |
| 75 | 4 | 5 |
| 76 | 4 | 4 |
| 77 | 4 | 4 |

TABLE 22-continued

[Example 2] Water Resistance

| No. | 5 parts | 10 parts |
|---|---|---|
| 78 | 4 | 4 |
| 79 | 4 | 4 |
| 80 | 4 | 4 |
| 81 | 4 | 4 |
| 82 | 4 | 5 |
| 83 | 4 | 5 |
| 84 | 4 | 5 |
| 85 | 4 | 5 |
| 86 | 4 | 5 |
| 87 | 4 | 5 |
| 88 | 4 | 5 |
| 89 | 4 | 5 |
| 90 | 4 | 5 |
| 91 | 4 | 5 |
| 92 | 4 | 5 |
| 93 | 4 | 5 |

TABLE 23

[Example 2] Degree of Blotting

| No. | 5 parts | 10 parts |
|---|---|---|
| 1 | 2 | 2 |
| 2 | 2 | 2 |
| 3 | 2 | 2 |
| 4 | 2 | 2 |
| 5 | 2 | 2 |
| 6 | 2 | 2 |
| 7 | 2 | 2 |
| 8 | 2 | 2 |
| 9 | 2 | 2 |
| 10 | 2 | 2 |
| 11 | 2 | 2 |
| 12 | 2 | 2 |
| 13 | 2 | 2 |
| 14 | 2 | 2 |
| 15 | 2 | 2 |
| 16 | 2 | 2 |
| 17 | 2 | 2 |
| 18 | 2 | 2 |
| 19 | 2 | 2 |
| 20 | 2 | 2 |
| 21 | 2 | 2 |
| 22 | 2 | 2 |
| 23 | 2 | 2 |
| 24 | 2 | 2 |
| 25 | 2 | 2 |
| 26 | 2 | 2 |
| 27 | 2 | 2 |
| 28 | 2 | 2 |
| 29 | 2 | 2 |
| 30 | 2 | 2 |
| 31 | 2 | 2 |
| 32 | 2 | 2 |
| 33 | 2 | 2 |
| 34 | 2 | 2 |
| 35 | 2 | 2 |
| 36 | 2 | 2 |
| 37 | 2 | 2 |
| 38 | 2 | 2 |
| 39 | 2 | 2 |
| 40 | 2 | 2 |
| 41 | 2 | 2 |
| 42 | 2 | 2 |
| 43 | 2 | 2 |
| 44 | 2 | 2 |
| 45 | 2 | 2 |
| 46 | 2 | 2 |
| 47 | 2 | 2 |
| 48 | 2 | 2 |
| 49 | 2 | 2 |

TABLE 23-continued

| [Example 2] Degree of Blotting | | |
|---|---|---|
| No. | 5 parts | 10 parts |
| 50 | 2 | 2 |
| 51 | 2 | 2 |
| 52 | 2 | 2 |
| 53 | 2 | 2 |
| 54 | 2 | 2 |
| 55 | 2 | 2 |
| 56 | 2 | 2 |
| 57 | 2 | 2 |
| 58 | 2 | 2 |
| 59 | 2 | 2 |
| 60 | 2 | 2 |
| 61 | 2 | 2 |
| 62 | 2 | 2 |
| 63 | 2 | 2 |
| 64 | 2 | 2 |
| 65 | 2 | 2 |
| 66 | 2 | 2 |
| 67 | 2 | 2 |
| 68 | 2 | 2 |
| 69 | 2 | 2 |
| 70 | 2 | 2 |
| 71 | 2 | 2 |
| 72 | 2 | 2 |
| 73 | 2 | 2 |
| 74 | 2 | 2 |
| 75 | 2 | 2 |
| 76 | 2 | 2 |
| 77 | 2 | 2 |
| 78 | 2 | 2 |
| 79 | 2 | 2 |
| 80 | 2 | 2 |
| 81 | 2 | 2 |
| 82 | 2 | 2 |
| 83 | 2 | 2 |
| 84 | 2 | 2 |
| 85 | 2 | 2 |
| 86 | 2 | 2 |
| 87 | 2 | 2 |
| 88 | 2 | 2 |
| 89 | 2 | 2 |
| 90 | 2 | 2 |
| 91 | 2 | 2 |
| 92 | 2 | 2 |
| 93 | 2 | 2 |

TABLE 24

| [Example 2] Ink Absorbency | | |
|---|---|---|
| No. | 5 parts | 10 parts |
| 1 | 3 | 3 |
| 2 | 3 | 3 |
| 3 | 3 | 3 |
| 4 | 3 | 3 |
| 5 | 3 | 3 |
| 6 | 3 | 3 |
| 7 | 3 | 3 |
| 8 | 3 | 3 |
| 9 | 3 | 3 |
| 10 | 3 | 3 |
| 11 | 3 | 3 |
| 12 | 3 | 3 |
| 13 | 3 | 3 |
| 14 | 3 | 3 |
| 15 | 3 | 3 |
| 16 | 3 | 3 |
| 17 | 3 | 3 |
| 18 | 3 | 3 |
| 19 | 3 | 3 |
| 20 | 3 | 3 |
| 21 | 3 | 3 |

TABLE 24-continued

| [Example 2] Ink Absorbency | | |
|---|---|---|
| No. | 5 parts | 10 parts |
| 22 | 3 | 3 |
| 23 | 3 | 3 |
| 24 | 3 | 3 |
| 25 | 3 | 3 |
| 26 | 3 | 3 |
| 27 | 3 | 3 |
| 28 | 3 | 3 |
| 29 | 3 | 3 |
| 30 | 3 | 3 |
| 31 | 3 | 3 |
| 32 | 3 | 3 |
| 33 | 3 | 3 |
| 34 | 3 | 3 |
| 35 | 3 | 3 |
| 36 | 3 | 3 |
| 37 | 3 | 3 |
| 38 | 3 | 3 |
| 39 | 3 | 3 |
| 40 | 3 | 3 |
| 41 | 3 | 3 |
| 42 | 3 | 3 |
| 43 | 3 | 3 |
| 44 | 3 | 3 |
| 45 | 3 | 3 |
| 46 | 3 | 3 |
| 47 | 3 | 3 |
| 48 | 3 | 3 |
| 49 | 3 | 3 |
| 50 | 3 | 3 |
| 51 | 3 | 3 |
| 52 | 3 | 3 |
| 53 | 3 | 3 |
| 54 | 3 | 3 |
| 55 | 3 | 3 |
| 56 | 3 | 3 |
| 57 | 3 | 3 |
| 58 | 3 | 3 |
| 59 | 3 | 3 |
| 60 | 3 | 3 |
| 61 | 3 | 3 |
| 62 | 3 | 3 |
| 63 | 3 | 3 |
| 64 | 3 | 3 |
| 65 | 3 | 3 |
| 66 | 3 | 3 |
| 67 | 3 | 3 |
| 68 | 3 | 3 |
| 69 | 3 | 3 |
| 70 | 3 | 3 |
| 71 | 3 | 3 |
| 72 | 3 | 3 |
| 73 | 3 | 3 |
| 74 | 3 | 3 |
| 75 | 3 | 3 |
| 76 | 3 | 3 |
| 77 | 3 | 3 |
| 78 | 3 | 3 |
| 79 | 3 | 3 |
| 80 | 3 | 3 |
| 81 | 3 | 3 |
| 82 | 3 | 3 |
| 83 | 3 | 3 |
| 84 | 3 | 3 |
| 85 | 3 | 3 |
| 86 | 3 | 3 |
| 87 | 3 | 3 |
| 88 | 3 | 3 |
| 89 | 3 | 3 |
| 90 | 3 | 3 |
| 91 | 3 | 3 |
| 92 | 3 | 3 |
| 93 | 3 | 2 |

TABLE 25

| | | Water Resistance | Degree of Blotting | Ink Absorbency |
|---|---|---|---|---|
| Comparative | 1 | 1 | 2 | 1 |
| Example | 2 | 1 | 2 | 1 |

From the results of Tables 19 to 25, it was confirmed that the printing and recording sheets of the invention have a good water resistance, a reduced degree of blotting, and good ink absorbency, and thus, clear images could be obtained.

What is claimed is:

1. A printing and recording sheet comprising a substrate and an ink receiving layer of a crosslinked product of a composition which comprises a polymer resin and a crosslinking agent comprising a water-soluble of dispersible carbodiimide compound which is a condensation reaction product obtained by decarbonation condensation of at least one diisocyanate or a mixture of at least one diisocyanate and at least one triisocyanate, said reaction product being blocked at terminal isocyanate groups with a hydrophilic group.

2. A printing and recording sheet according to claim 1, wherein said composition contains a filler.

3. The printing and recording sheet according to claim 1; wherein the terminal isocyanate groups are blocked with (C) a monofunctional water-soluble or dispersible organic compound.

4. The printing and recording sheet according to claim 3; wherein the monofunctional water-soluble or dispersible organic compounds (C) have a functional group capable of reacting with an isocyanate group selected from the group consisting of OH group, COOH group, $NH_2$ group, and $SO_3H$ group.

5. The printing and recording sheet according to claim 3; wherein the monofunctional water-soluble or dispersible organic compounds (C) are selected from the group consisting of monoalkyl esters, monoalkyl ethers of polyethylene glycol and polypropylene glycol, monofunctional organic compounds having a cationic functional group and monofunctional organic compounds having an anionic functional group.

6. The printing and recording sheet according to claim 3; wherein the monofunctional water-soluble or dispersible organic compounds (C) is added to the total isocyanate groups in a molar mixing ratio range of 1.1:1 to 16:1.

7. The printing and recording sheet according to claim 3; wherein the theoretical degree of polymerization of carbodiimide is 0.1 to 15.

8. The printing and recording sheet according to claim 1; wherein the decarbonation condensation reaction is performed with an organophosphorous catalyst.

9. The printing and recording sheet according to claim 8; wherein the organophosphorous catalyst is selected from the group consisting of 3-methyl-1-phenyl-2-phosphorene-1-oxide, 3-methyl-1-ethyl-2-phosphorene-1-oxide, 1,3-dimethyl-2-phosphorene-1-oxide, 1-phenyl-2-phosphorene-1-oxide, 1-ethyl-2-phosphorene-1-oxide, 1-methyl-2-phosphorene-1-oxide, and double-bond isomers thereof.

10. A printing and recording sheet comprising a substrate and an ink receiving layer of a crosslinked product of a composition which comprises a polymer resin and a crosslinking agent comprising a water-soluble or dispersible carbodjimide compound which is a condensation reaction product obtained by decarbonation condensation of at least one diisocyanate or a mixture of at least one diisocvanate and at least one triisocyanate, said reaction product being blocked at terminal isocyanate groups with a hydrophilic group; wherein said at least one diisocyanate and said at least one triisocyanate are selected from the group consisting of 4,4'-dicyclohexylmethane diisocyanate (HMDI), tetramethylxylylene diisocyanate (TMXDI), isophorone diisocyanate (IPDI), 2,4,6-triisopropylphenyl diisocyanate (TIDI), 4,4'-diphenylmethane diisocyanate (MDI), tolylene diisocyanate (TDI), hydrogenated tolylene diisocyanate (HTDI) and an isocyanate having at least two isocyanate groups bonded to the carbon of the methylene group in the molecule.

11. A printing and recording sheet according to claim 10, wherein said isocyanate having at least two isocyanate groups bonded to the carbon of the methylene group in the molecule is one or more members selected from the group consisting of hexamethylene diisocyanate (HDI), hydrogenated xylylene diisocyanate ($H_6XDI$), xylylene diisocyanate (XDI), 2,2,4-trimethylhexamethylene diisocyanate (TMHDI), 1,12-diisocyanatododecane(DDI), norbornane diisocyanate (NBDI) and 2,4-bis-(8-isocyanatooctyl)-1,3-dioctylcyclobutane (OCDI).

12. A printing and recording sheet comprising a substrate and an ink receiving layer of a crosslinked product of a composition which comprises a polymer resin and a crosslinking agent comprising a water-soluble or dispersible carbodiimide compound which is a condensation reaction product obtained by decarbonation condensation of at least one diisocyanate or a mixture of at least one disocyanate and at least one triisocyanate, said reaction product being blocked at terminal isocyanate groups with a hydrophilic group; wherein said polymer resin is a polyvinyl alcohol resin.

13. The printing and recording sheet according to claim 12; wherein the polyvinyl alcohol resins are partially saponified, completely saponified, cation-modified, or anion-modified resins.

14. The printing and recording sheet according to claim 13; wherein the polyvinyl alcohol resins are saponified by a reaction between an ethylenically unsaturated monomer having a carboxyl group, a sulfonate group or an ammonium base and a vinyl ester.

15. The printing and recording sheet according to claim 14; wherein the ethylenically unsaturated monomer is selected from the group consisting of an crotonic acid, itaconic acid, monomethyl maleate, acrylic acid, methyl acrylate, maleic anhydride, vinylsulfonic acid, allysulfonic acid, N-(meth)acrylamidopropanesulfonic acid, trimethyl-3-(1-(meth)acrylamido-1,1-dimethylpropyl) ammonium chloride, trimethyl-3-(1-(meth)acrylamido- 1,1-dimethylethyl) ammonium chloride, trimethyl-3-(1-(meth) acrylamidopropyl) ammonium chloride, N-vinylimidazole, and N-vinyl-N-methylimidazole.

16. The printing and recording sheet according to claim 12; wherein the saponified polyvinyl alcohol have anionic or cationic groups in the range of 0.1 to 10 mole %.

17. The printing and recording sheet according to claim 12; wherein the water-soluble or dispersible carbodiimide compound is added in a range of 0.5 to 50 parts by weight as a solid based on 100 parts by weight of polyvinyl alcohol resin.

* * * * *

UNITED STATES PATENT AND TRADEMARK OFFICE

CERTIFICATE OF CORRECTION

PATENT NO. : 6,177,197 B1
DATED : January 23, 2001
INVENTOR(S) : Yasuo Imashiro; Ikuo Takahashi; Naofumi Horie; Takeshi Yamane; Shigekazu Suzuki It is certified that error appears in the above-identified patent and that said Letters Patent is hereby corrected as shown below:

Title page,
Item [73], Assignee: [Nippon Industries, Inc.,] Nisshinbo Industries, Inc., Tokyo (JP)

Signed and Sealed this

Fifth Day of February, 2002

*Attest:*

*Attesting Officer*

JAMES E. ROGAN
*Director of the United States Patent and Trademark Office*